US005553672A

United States Patent [19]

Smith, Jr. et al.

[11] Patent Number: 5,553,672

[45] Date of Patent: Sep. 10, 1996

[54] SETTING TOOL FOR A DOWNHOLE TOOL

[75] Inventors: Sidney K. Smith, Jr., Conroe; Danny J. Holder, Spring, both of Tex.

[73] Assignee: Baker Hughes Incorporated, Houston, Tex.

[21] Appl. No.: 320,056

[22] Filed: Oct. 7, 1994

[51] Int. Cl.[6] ..... E21B 23/01; E21B 23/04

[52] U.S. Cl. ..... 166/382; 166/120; 166/123; 166/212

[58] Field of Search ..... 166/123, 382, 166/212, 120, 387

[56] References Cited

U.S. PATENT DOCUMENTS

| | | | |
|---|---|---|---|
| 2,290,142 | 7/1942 | Burt | 166/208 X |
| 2,315,931 | 4/1943 | Burt et al. | 166/208 X |
| 3,180,419 | 4/1965 | Cochran et al. | 166/120 |
| 3,291,220 | 12/1966 | Mott | 166/212 X |
| 3,460,618 | 8/1969 | Brown et al. | 166/208 X |
| 4,237,979 | 12/1980 | Weise | 166/123 X |
| 4,823,882 | 4/1989 | Stokley et al. | 166/387 |
| 4,862,966 | 9/1989 | Lindsey et al. | 166/382 |
| 4,926,939 | 5/1990 | Baugh | 166/208 |

OTHER PUBLICATIONS

*Liner Hangers, People and Products Providing Solutions for Completions, Workovers and Fishing,* Baker Oil Tools Catalogue, Baker Oil Tools, Jun. 1994.

*Primary Examiner*—Hoang C. Dang

*Attorney, Agent, or Firm*—Rosenblatt & Redano, P.C.

[57] ABSTRACT

A setting tool allows setting a hydraulic liner hanger in a deviated wellbore. Subsequent to setting the liner hanger through pressure developed within the setting tool, the setting tool is reconfigured to allow full-bore passage therethrough. In the preferred embodiment, the flow communication to the liner hanger is interrupted after it is set so that the setting tool can have a full-bore clearance for passage of cement wipers or other devices and that pressure can then be applied in the setting tool to complete the cementing operations for the liner, as well as to actuate any casing or isolation packers.

41 Claims, 14 Drawing Sheets

SETTING TOOL FOR A DOWNHOLE TOOL

FIELD OF THE INVENTION

The field of this invention relates to downhole tools, particularly setting tools for hydraulic liners and, more particularly, setting tools adaptable to actuate hydraulic liner hangers in deviated wellbores.

BACKGROUND OF THE INVENTION

Typically, liners are used below casing in wellbores to extend the casing. A liner is a section of casing that is suspended downhole in existing casing. In most cases it extends downwardly into open hole and overlaps the existing casing by approximately 200–400 ft. The liner is sometimes cemented in place. In the past, hydraulic liner hangers have been preferred by operators in deviated wellbores over mechanical liner hangers. This is because the deviation in the wellbore makes it less certain that the hanger mechanism will be properly actuated in a deviated wellbore. Instead, well operators in deviated wellbores have preferred the hydraulically set liner hangers. In prior designs the liner with a setting tool would be lowered into position and pressure within the setting tool would be used to set the hydraulic liner hanger through a lateral port therein. In prior designs the flow passage through the setting tool would have to be obstructed at its lowermost end so that applied pressure in the setting tool would properly reach the hydraulic liner hanger. The obstruction for the setting tool would have to be near the bottom to allow a cement wiper plug the ability to pass completely through the setting tool and liner to remove residual cement therefrom. Alternatively, if the residual cement were not removed, cutting or grinding operations would have to be under-taken to remove any excess cement within the liner. Since a lateral port to the hydraulic liner hanger remained open in prior designs, an additional trip into the wellbore was necessary, subsequent to the setting of the hydraulic liner hanger, to properly position a setting tool for subsequent actuation of other downhole equipment attached to the liner, such as an external casing packer.

The operations involving prior designs lengthened the time required to complete the placement and cementing of a liner. Accordingly, the apparatus and method of the present invention were developed to improve techniques for setting hydraulic liner hangers. At the same time, the apparatus and method of the present invention were developed to allow in one operation the setting of the liner hanger while at the same time providing a clear path through the setting tool to allow the passage of cement wipers if the liner is cemented so that in one operation, the hydraulic liner hanger can be set and the liner cemented, as well as setting any casing or isolation packers attached to the liner.

SUMMARY OF THE INVENTION

A setting tool allows setting a hydraulic liner hanger in a deviated wellbore. Subsequent to setting the liner hanger through pressure developed within the setting tool, the setting tool is reconfigured to allow full-bore passage therethrough. In the preferred embodiment, the flow communication to the liner hanger is interrupted after it is set so that the setting tool can have a full-bore clearance for passage of cement wipers or other devices and that pressure can then be applied in the setting tool to complete the cementing operations for the liner, as well as to actuate any casing or isolation packers.

DETAILED DESCRIPTION OF THE PREFERRED EMBODIMENT

Figure 1A:
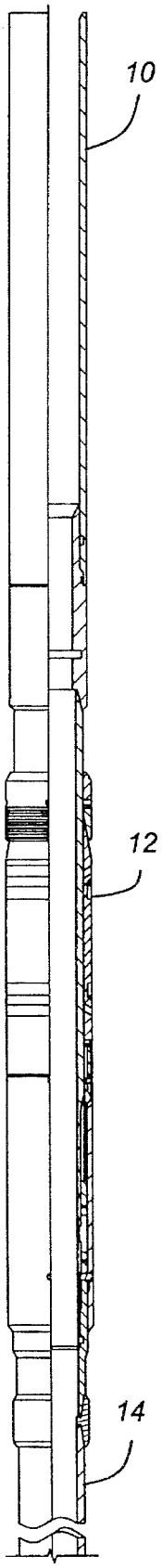
FIGS. 1A–1D are an exterior elevational view of a liner assembly, illustrating the use of the hydraulic liner hanger as well as casing and isolation packers.
Figure 1B:
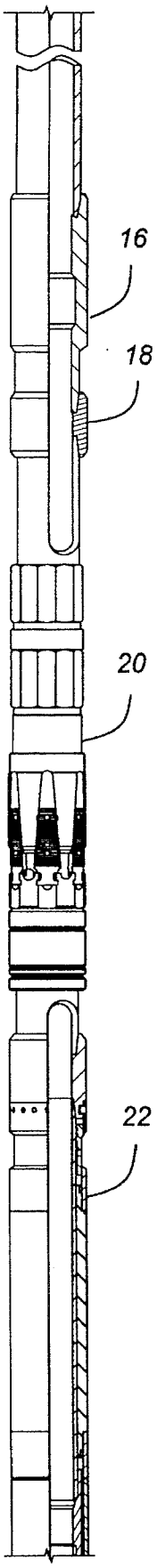
Figure 1C:
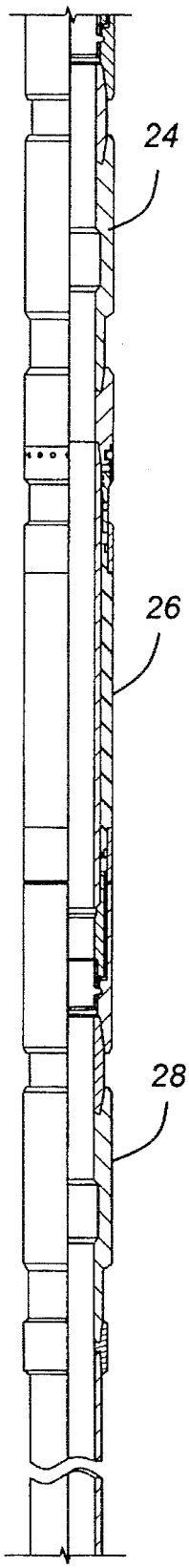
Figure 1D:
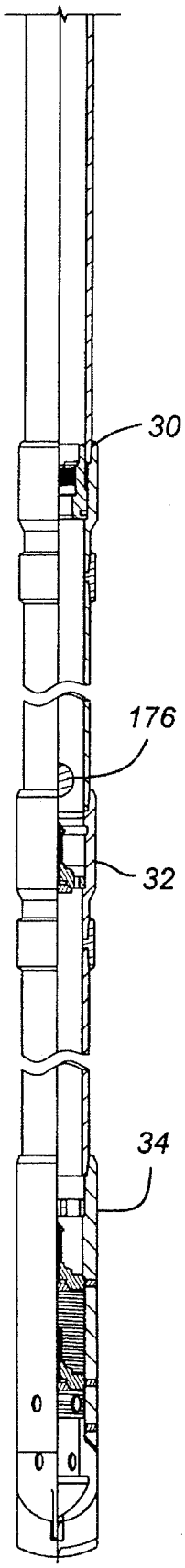
Figure 2A:
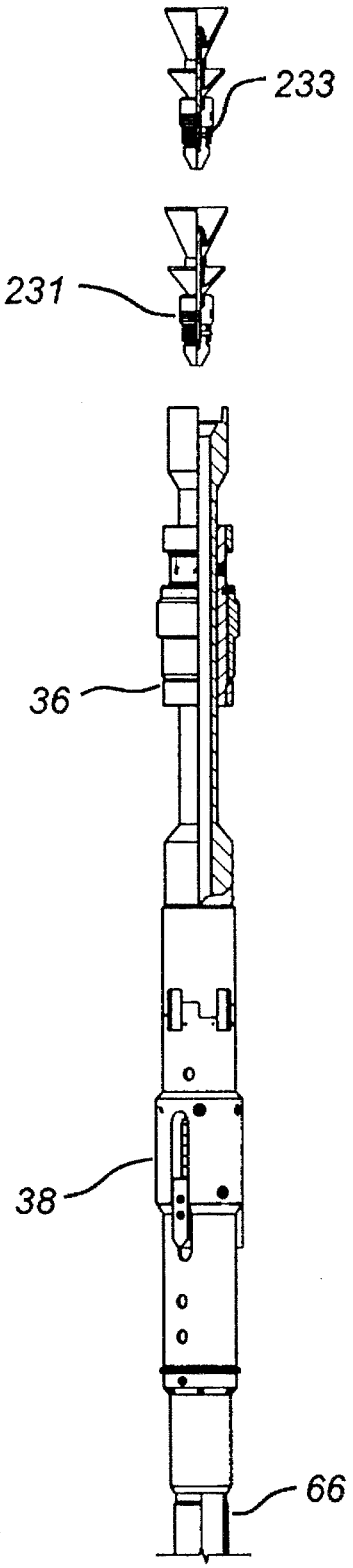
FIGS. 2A–2C are a schematic elevational view of an assembly of setting accessories, which include in the assembly the apparatus of the present invention.
Figure 2B:
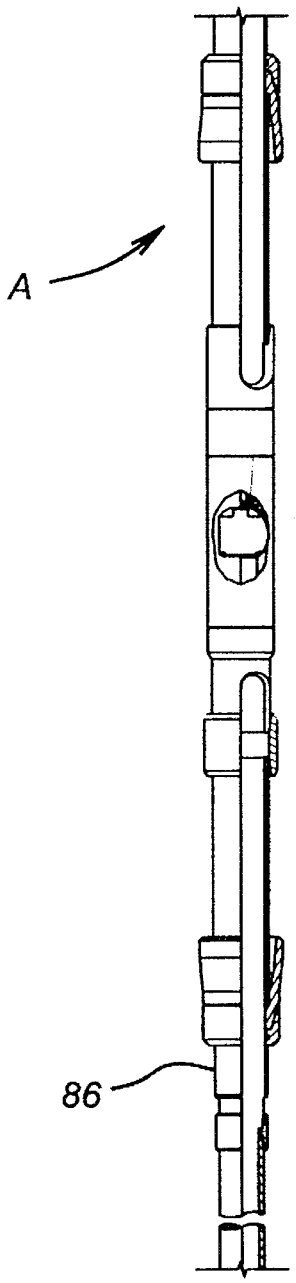

The apparatus A is illustrated in detail in FIGS. 3 and 4. FIG. 2B illustrates how the apparatus A fits in as a component of a series of setting accessories, all of which will be described below. To illustrate the operation of the apparatus A, a typical assembly of components for setting a liner will be described, as shown in FIG. 1. Those skilled in the art will understand that the apparatus A can be employed with other installations and that the component assembly illustrated in FIG. 1 is for illustrative purposes only. Beginning at the uppermost end, a liner setting sleeve, such as Baker HR model, product No. 295-26, is indicated by 10. The setting sleeve 10 is connected to a Baker H isolation packer 12, preferably product No. 281-02. Thereafter, a casing joint or joints 14 are employed and such joint or joints 14 support an indicating sub 16. Casing collar 18 connects sub 16 to rotating hydraulic flex-lock liner hanger, such as Baker Oil Tools product No. 292-51, indicated by 20. Below liner hanger 20 is casing packer 22, preferably Baker Oil Tools product No. 301-09. Packer 22 is connected to indicating sub 24, which in turn can support another casing packer 26, which can be identical to casing packer 22 or a different design. Below casing packer 26 is an indicating sub 28. Ultimately, indicating sub 28 is connected to landing collar 30, preferably Baker Oil Tools product No. 274-10. Landing collar 30 is connected to float collar with baffle 32, preferably Baker Oil Tools product No. 999-03. The float collar 32 is in turn connected to a set shoe 34, preferably Baker Oil Tools product No. 999-03.

Figure 2C:
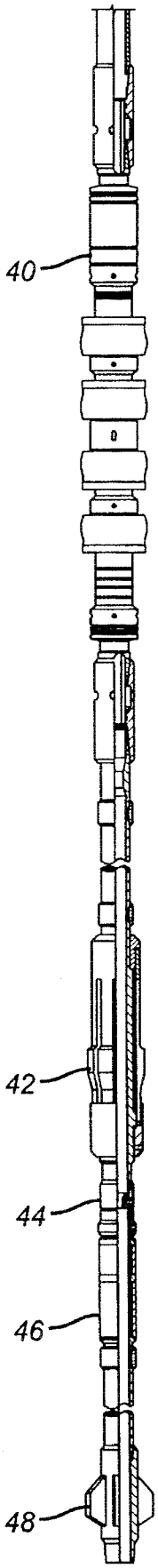
Figure 4A:
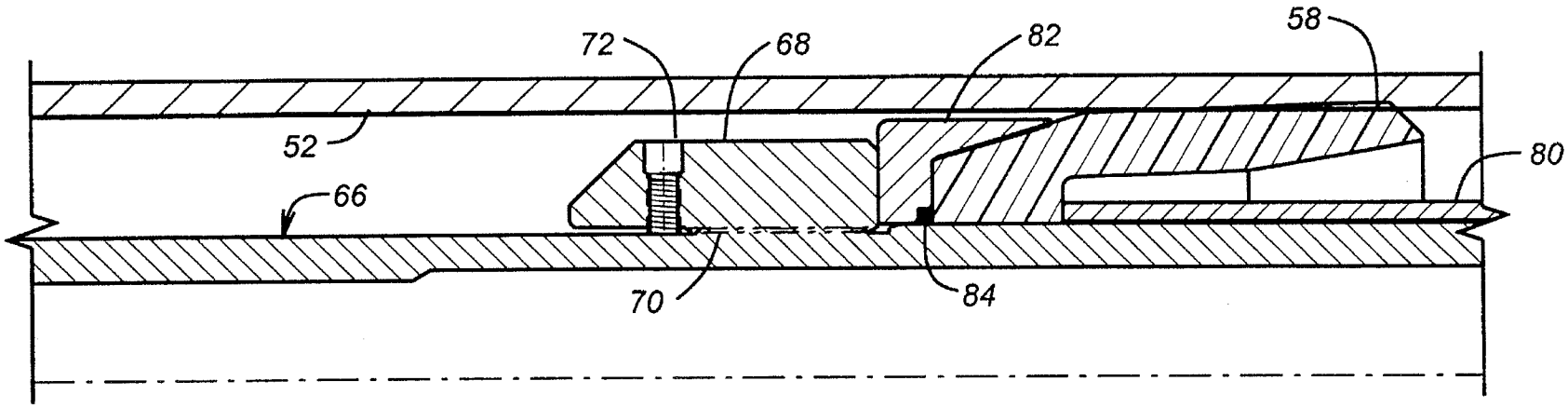
FIGS. 4A–4G illustrate the tool of FIG. 3 in the shifted position with the hydraulic liner set.
Figure 4B:
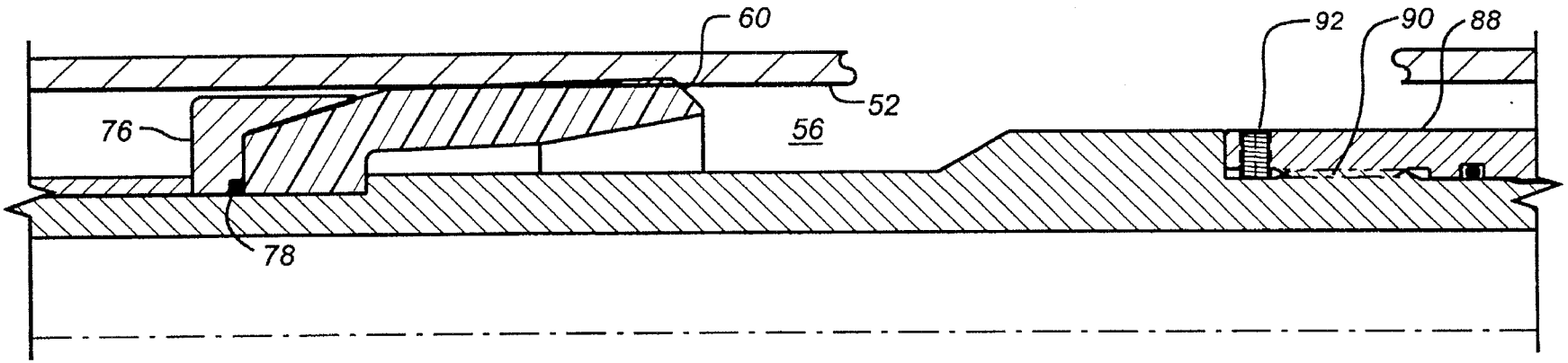

The apparatus A of the present invention is illustrated in FIG. 2B. In FIGS. 2A–2C, it is part of an assembly of tools used for the setting of the liner hanger 20, as well as the setting of packers 12, 22, and 26. The assembly illustrated in FIGS. 2A–2C comprises a lift nipple 36, preferably Baker Oil Tools product No. 265-20, which is in turn connected to a liner setting tool, a portion of which is the apparatus A. The liner setting tool 38 has a release portion, preferably Baker Oil Tools product No. 266-66. Below the apparatus A of the present invention, as illustrated in FIG. 2C, is a wash tool 40, which is in turn connected to an indicator collet 42. A model E Baker Oil Tools wash tool may be used for item 40. A "wash tool" is intended to include all types of packing setting tools or other sealing devices. Below the indicator collet 42 is ball seat 44, followed by expansion joint 46 and fluted centralizer 48.

Figure 3A:
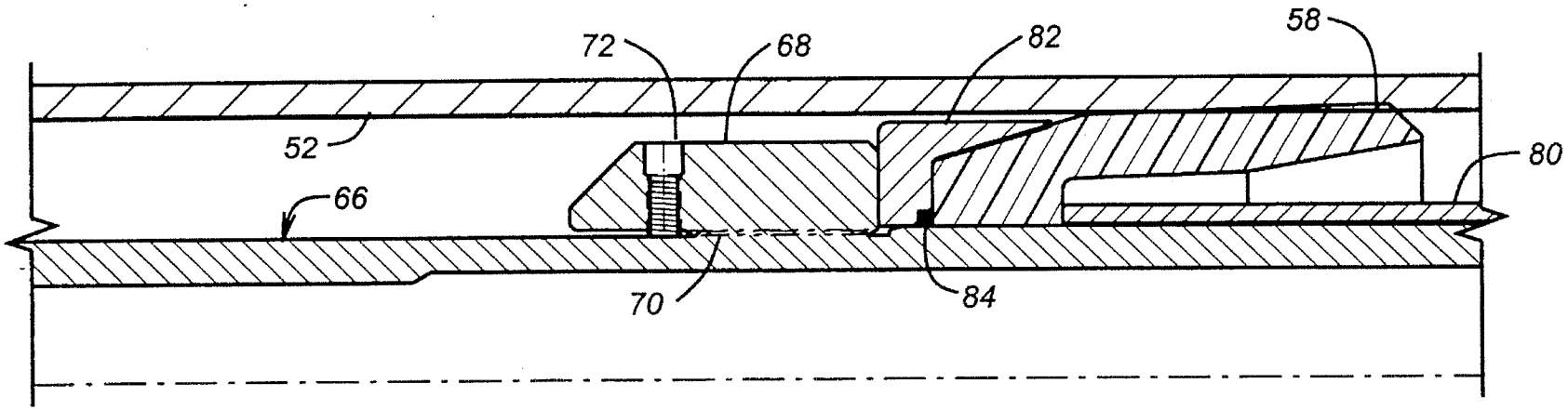
FIGS. 3A–3G illustrate the portion of the setting tool involving the apparatus and method of the present invention in the run-in position.
Figure 3B:
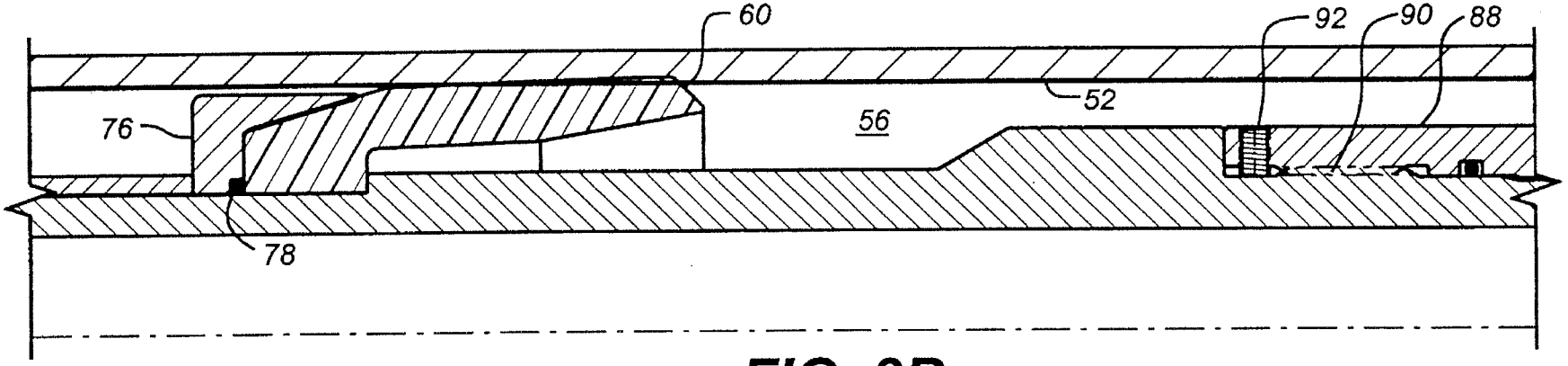
Figure 3C:
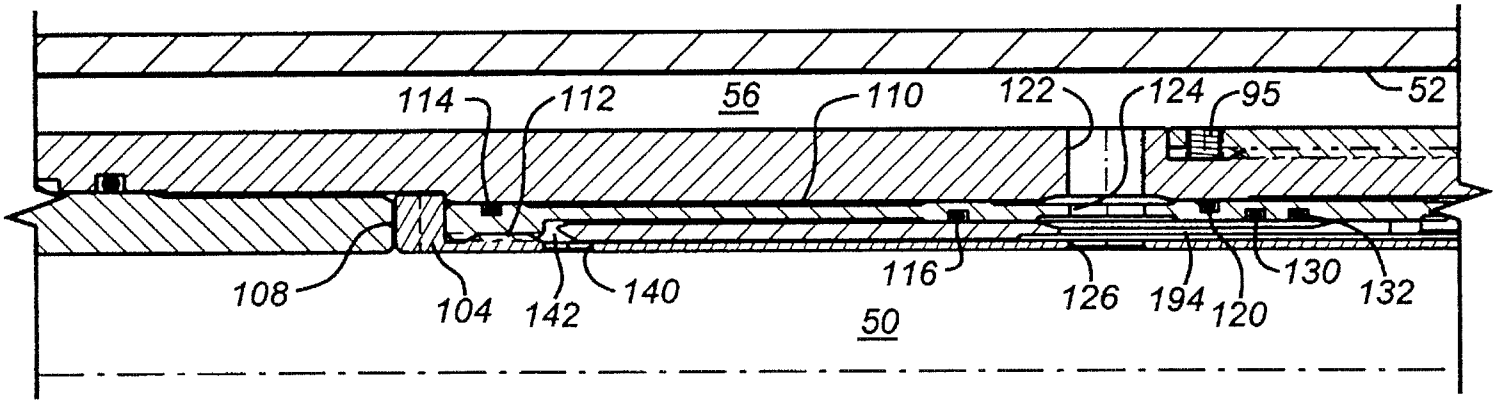
Figure 3D:
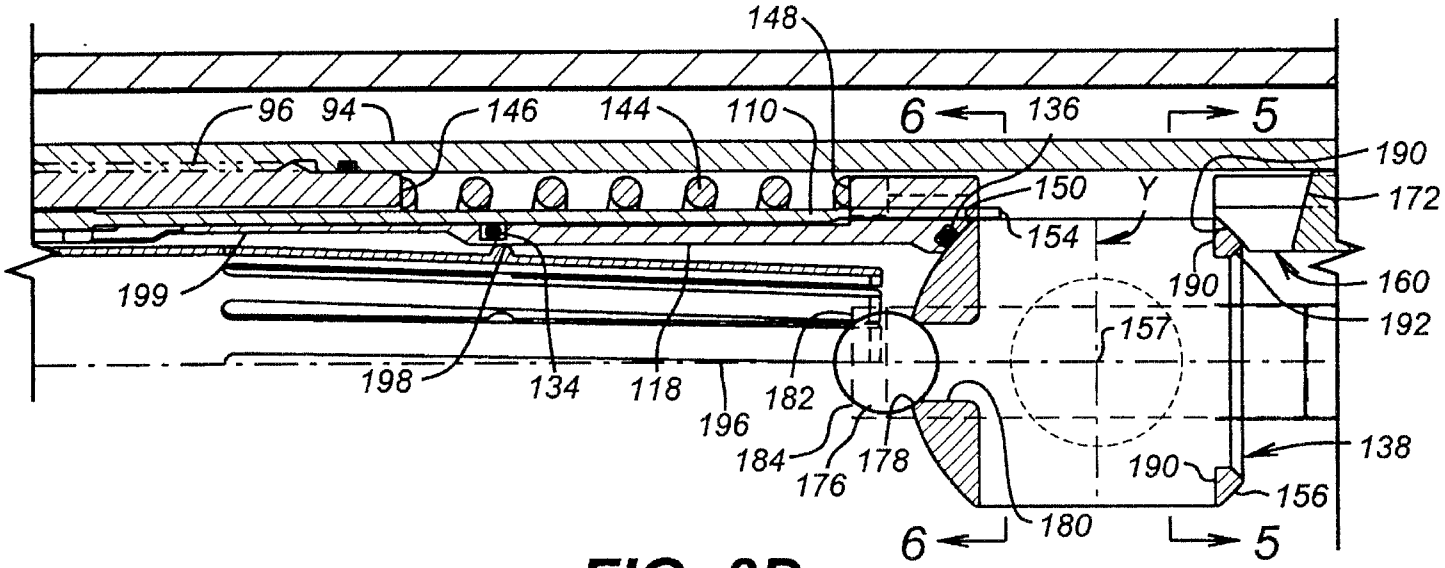
Figure 3E:
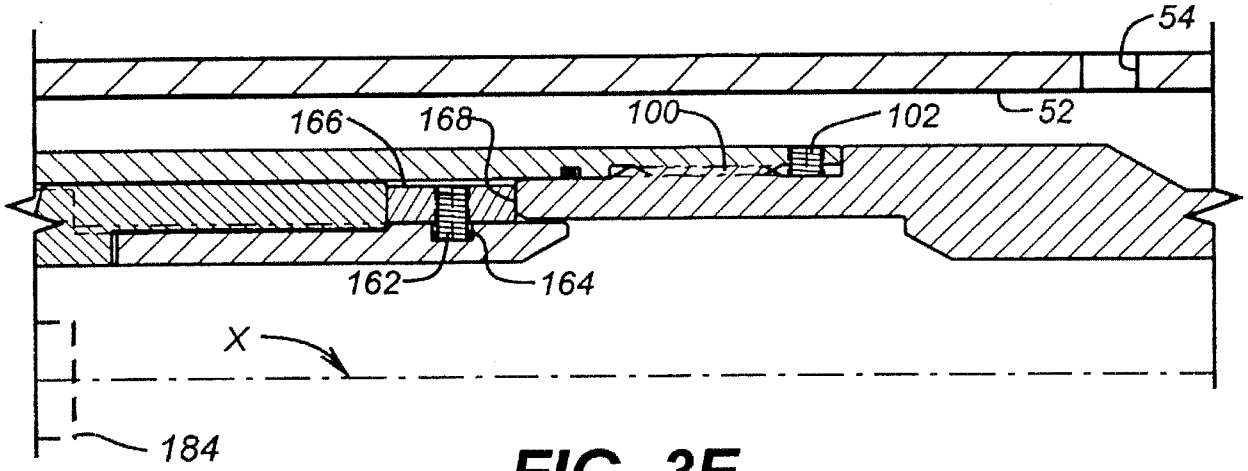
Figure 3F:
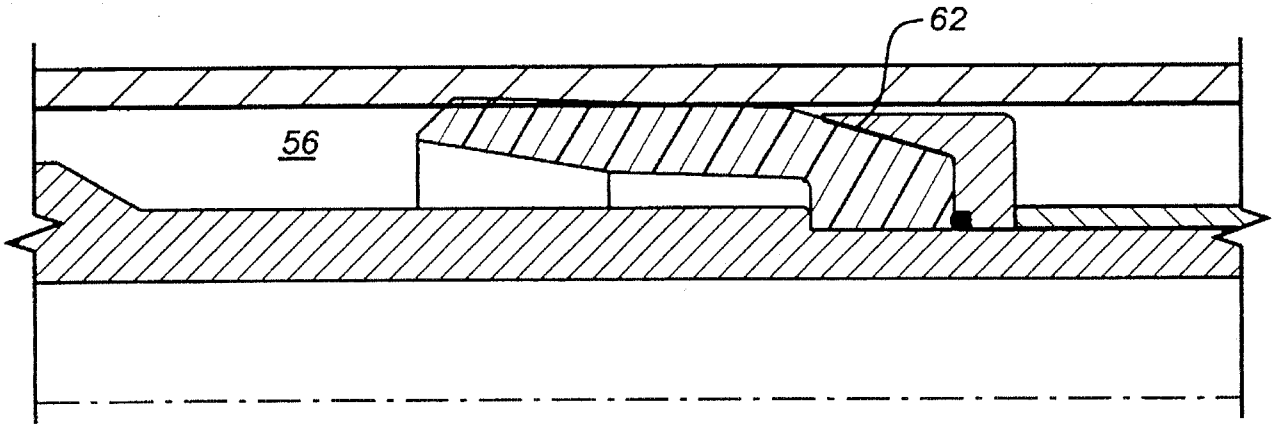
Figure 4F:
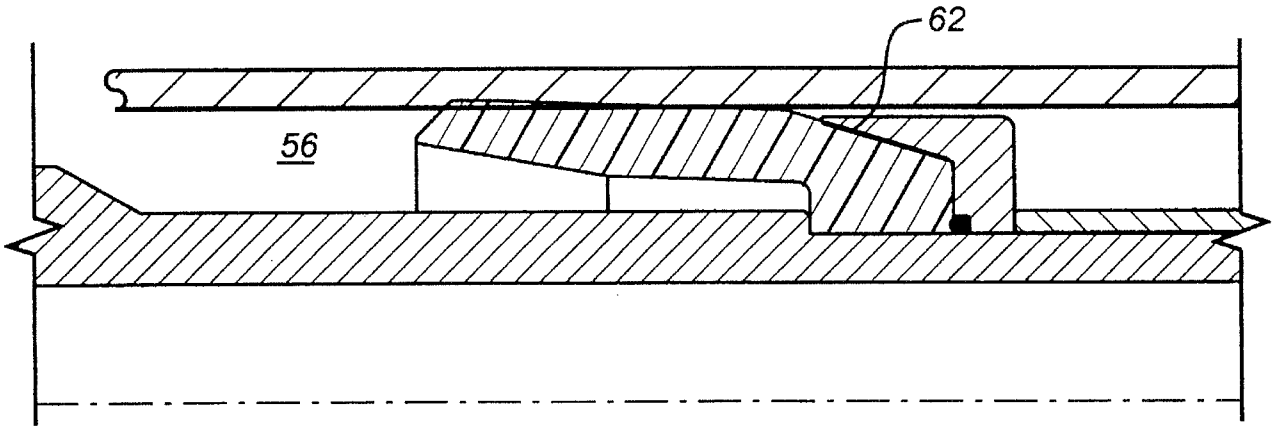
Figure 3G:
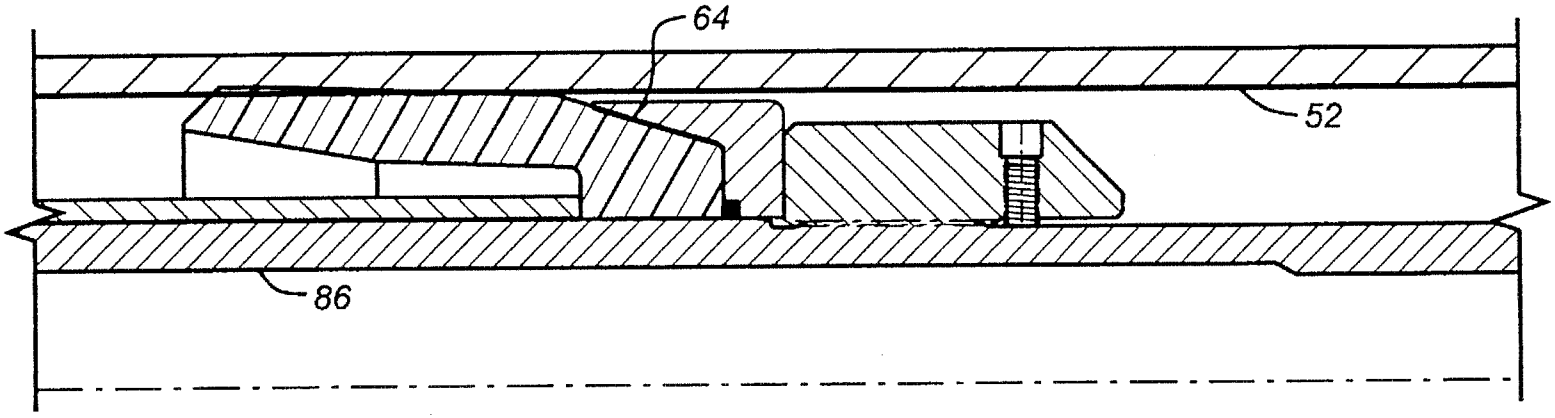
Figure 4G:
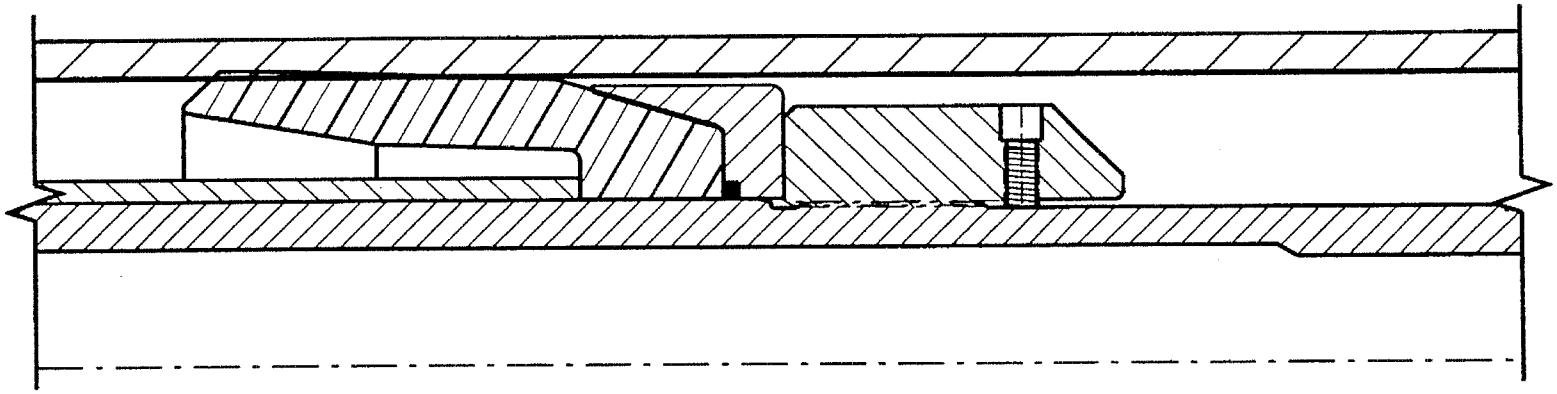

Referring now to FIGS. 3A–3G, the operation of setting the liner hanger 20, shown in FIG. 1B, using the apparatus in the setting string illustrated in FIGS. 2A–2C, will now be described. Those skilled in the art will appreciate that the setting assembly shown in FIGS. 2A–2C is inserted within the liner assembly illustrated in FIGS. 1A–1D for actuation of the liner hanger 20. One of the features of the apparatus A is the selective communication from internal bore 50 (see FIG. 3C) to the liner hanger 20. In FIGS. 3A–3G, the inner wall 52 of liner 20 is illustrated to show juxtaposition when the apparatus A is inserted within the assembly illustrated in FIG. 1A–1D. Inner wall 52 has a port 54 which communicates with the actuating mechanism for the slips in the liner hanger 20. As seen in FIG. 3C, there is fluid communication to liner hanger 20 in the run-in position of the apparatus A illustrated in FIGS. 3A–3G. This fluid communication occurs through previously mentioned port 54 in the housing of the liner hanger and continues into cavity 56. Cavity 56 is defined by the inner wall 52, upper cups 58 and 60, lower cups 62 and 64, and the outer surface of the apparatus A which is made up of composite sections as will be described below. The cups 58-64 are made of resilient materials. The cup-shaped seals 58 and 60 are secured to upper connection 66. Upper connection 66 is threaded to facilitate its connection to liner setting tool 38 (see FIG. 2A). Upper connection 66 threadedly engages stop ring 68 at thread 70. Set screw 72 secures the engagement at thread 70. Upper seal 60 rests on a shoulder on ring 209 (see FIG. 7). Thimble 76 secures seal 60 against shoulder 74, with the engagement being further sealed off against upper connection 66 by O-ring 78. A spacer 80 separates seals 58 and 60, while thimble 82, in conjunction with O-ring 84, sealingly engages seal 58 against spacer 80. Stop ring 68, when threaded on thread 70, secures the entire assembly previously described to the upper connection 66. At the lower end, as shown in FIGS. 3F and 3G, the mounting system for seals 62 and 64 is nearly identical except that seal 60 is retained by ring 209 and the seals 62 and 64 are inverted as compared to the position of seals 58 and 60. Additionally, seals 62 and 64 are secured to lower connection 86 (see FIGS. 2B, 3F and 3G).

The connection between the upper connection 66 and lower connection 86 is completed by a series of sleeves. Tension nut 88 (see FIGS. 3B and 3C) is a sleeve which is secured to upper connection 66 at thread 90, with set screw 92 securing the connection. Sleeve 94 is engaged to tension nut 88 at thread 96, with set screw 98 securing the connection. At its lower end, sleeve 94 is secured to lower connection 86 at thread 100, with set screw 102 securing the connection. Accordingly, the connections between upper connection 66 and lower connection 86 have been fully described, thus now defining cavity 56, which extends between seals 60 and 62 at its upper and lower extremities, and outwardly to liner hanger 20 at its inner wall 52 and inwardly to the assembled combination of upper connection 66, tension nut 88, sleeve 94, and lower connection 86. It should be noted that seal 58 backs up seal 60, while seal 64 backs up seal 62 in the run-in position.

Referring now to the internal component assembly located within tension nut 88, ball guide 104 is secured between shoulder 106 on tension nut 88 and lower end 108 of upper connection 66. Trip ball lock 110 overlays ball guide 104 and is engaged to it at thread 112. By virtue of the threaded connection 112, the position of ball guide 104 is fixed against shoulder 106. Trip ball lock 110 is sealed against tension nut 88 by O-ring 114. O-ring 116 seals between the trip ball lock 110 and upper ball support 118. O-ring 120 seals between tension nut 88 and trip ball lock 110 just below lateral port 122, extending through tension nut 88. Trip ball lock 110 has at least one port 124 which is in alignment with at least one port 122 on tension nut 88 in the run-in position as shown in FIG. 3C. Ball guide 104 has a lateral port 126 which is in alignment with ports 122 and 124 in the run-in position shown in FIG. 3C. Seals 130 and 132 do not seal in the run-in position. However, seals 130 and 132 seal against upper ball support 118 in the shifted position shown in FIG. 4. Seal 134 seals between trip ball lock 110 and upper ball support 118. Seal 136 seals between the lower end of upper ball support 118 and trip ball 138, as shown in FIG. 3D. Finally, ball guide 104 has a port 140 which allows fluid communication into cavity 142. Those skilled in the art will appreciate that pressure applied to bore 50 will exert itself in cavity 142 as well as cavity 56 due to the aligned openings 122 and 124 (see FIG. 3C). It can further be seen that the pressure applied in bore 50 is channeled to cavity 56 due to the presence of O-rings 116, 120, 130 and 132, which prevent the applied pressure from escaping in other directions.

A spring 144 bears on shoulder 146 of tension nut 88, as shown in FIG. 3D. The other end of the spring 144 bears on upper ball support 118 at shoulder 148. Upper ball support 118 has a spherical lower surface 150, which is sealingly engaged to spherical surface 152 of trip ball 138, with seal 136 disposed therebetween. As shown in FIG. 3D, the trip ball lock 110 has a lower end 154 which, in the run-in position, extends beyond upper ball support 118, thus effectively preventing trip ball 138 from rotating about an axis passing through coordinate point 157 and extending perpendicular to the drawing. For ease in describing the ultimate movement of trip ball 138, the two axes in the plane of the drawing have been labeled as X and Y (see FIGS. 3D and 3E). As previously mentioned, the third axis, which can be considered the Z axis, extends perpendicular to the X and Y axes indicated in FIGS. 3D and 3E.

Trip ball 138 has a spherical surface 156 at its lower end, which abuts a mating spherical surface 158 on lower ball support 160. Lower ball support 160 is retained to lower connection 86 by virtue of a shear screw 162 extending into groove 164 in lower ball support 160. Shear screw 162 also extends into shear ring 166 which is prevented from downward movement due to its engagement to upper end 168 of lower connection 86. Accordingly, in the run-in position, shear screw or screws 162 retain lower ball support 160 in a fixed position, in turn supporting trip ball 138 and upper ball support 118. Spring 144 pushes that assembly downwardly and the force applied by spring 144 is resisted by the shear screw or screws 162.

Figure 5:
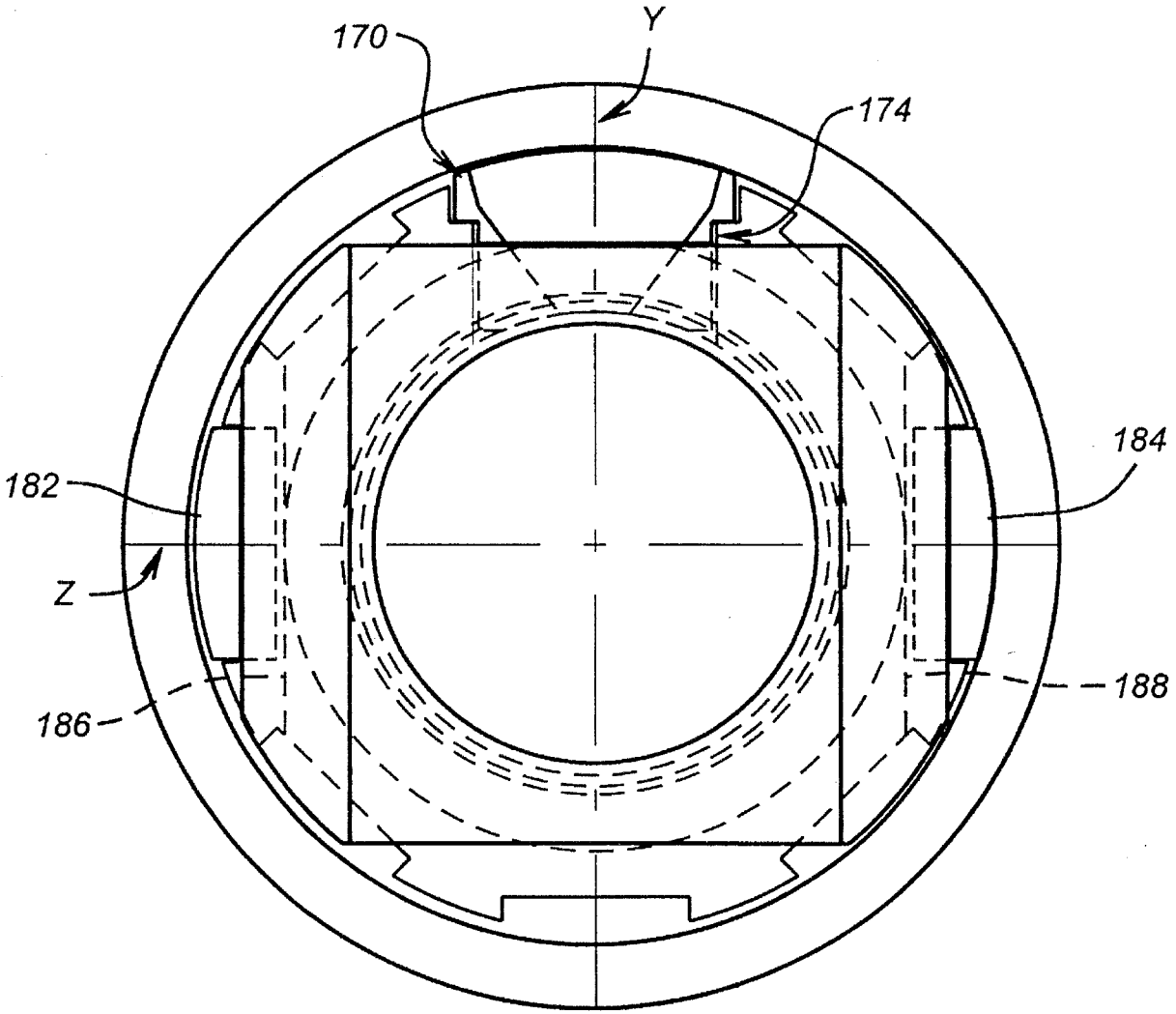
FIG. 5 is a sectional view taken along lines 5—5 of FIG. 3.
Figure 6:
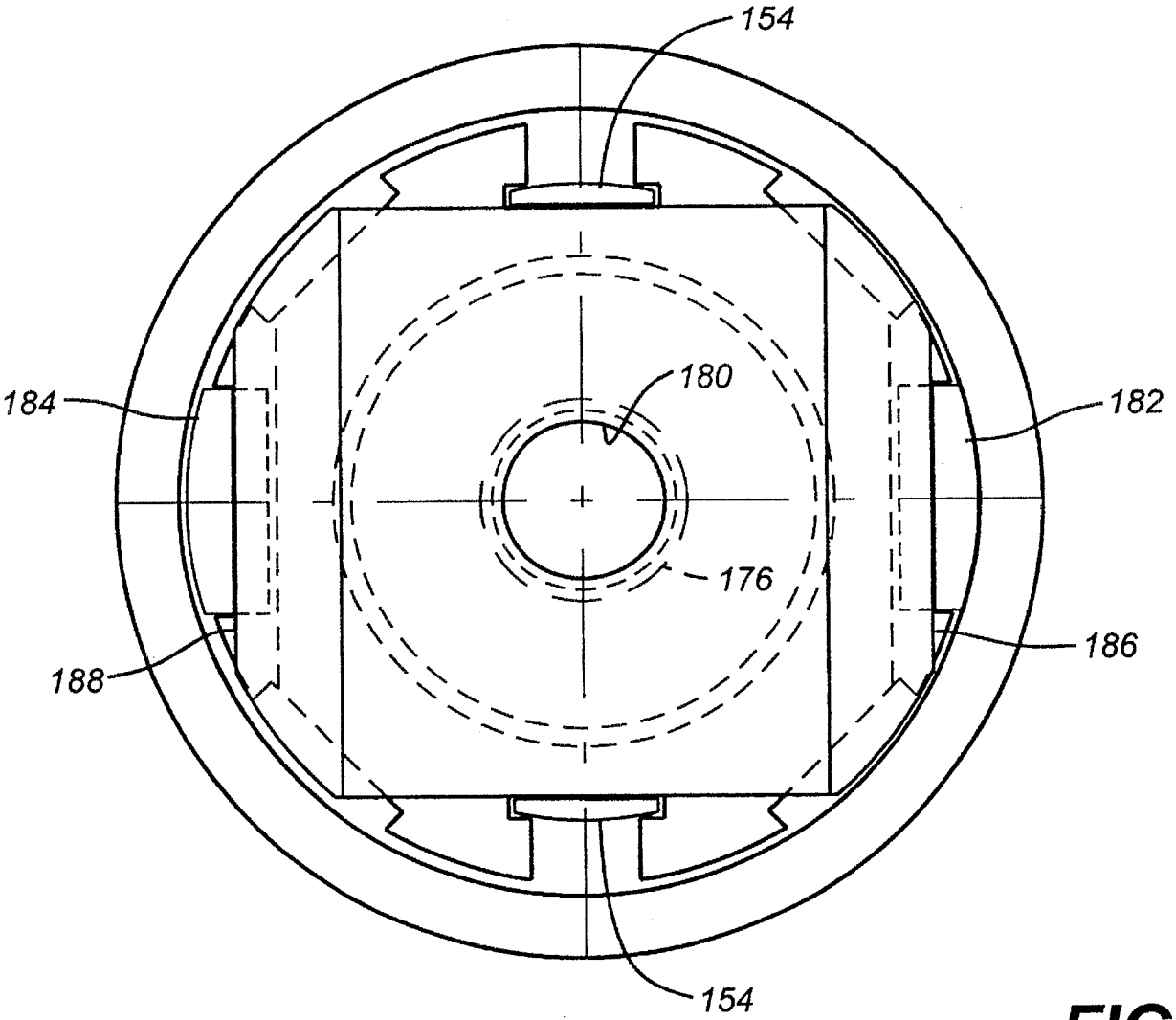
FIG. 6 is a sectional view taken along lines 6—6 of FIG. 3.

Nested within lower ball support 160 is trip arm 170. Trip arm 170 is supported on ring 166. Trip arm 170 has an upper surface 172 which extends through a notch 174 on lower ball support 160, as best seen in FIG. 5. Accordingly, upon shearing of shear screw or screws 162, the assembly of the lower ball support 160, trip ball 138, and upper ball support 118 can translate downwardly along the X axis until such time as surface 172 engages trip ball 138. The engagement of surface 172 with trip ball 138 initiates a rotational movement about an axis Z, perpendicular to axes X and Y.

In order to initiate such movements, a ball 176 is dropped from the surface until it seats against seat 178 on trip ball 138, effectively closing off port 180 in trip ball 138. Because the upper ball support 118 is sealingly engaged to the trip ball 138 in the run-in position, pressure applied in bore 50 once ball 176 seats on seat 178 results in a downward pressure along the X axis applied to substantially all of spherical surface 152. The pressure acting to shear shear screw 162 will be seen by a piston created by O-ring 134. At the same time, the pressure build-up in bore 50 above ball 176 communicates through cavity 56 to the hydraulic liner hanger 20 illustrated in FIG. 1. That applied pressure initially sets the hydraulic liner hanger 20. Upon further increase in pressure applied from the surface onto surface 152 with ball 176 seated on seat 198, a sufficient force is ultimately generated to shear screw or screws 162. Thereafter, trip ball 138 translates along the X axis until spherical surface 152 clears lower end 154 of trip ball lock 110. It should be noted that rotational movements about the X axis are prevented by bars 182 and 184. The positioning of bars 182 and 184 can best be seen by looking at FIG. 5. In FIG. 5, the X axis is perpendicular to the drawing, while the X and Z axes are displayed. The trip ball 138 has a pair of opposed flats 186 and 188 which are respectively presented in opposition to bars 182 and 184. As shown in FIGS. 3D and 3E, bars 182 and 184 span between lower ball support 160 and upper ball support 118. By their position on either side of the X axis from trip ball 138, rotation of trip ball 138 about the X axis is prevented throughout the duration of the translational movement of the assembly of the upper ball support 118, trip ball 138, and lower ball support 160. Eventually, trip ball 138 clears the lower end 154 of trip ball lock 110, and spherical surface 156 engages upper surface 172 of trip arm 170. Since trip arm 170 is retained against downward movement along the X axis by ring 166, the nature of the offcenter engagement of trip ball 138 with upper surface 172 begins a rotational movement about the Z axis as the assembly of the upper ball support 118, the trip ball 138, and the lower ball support 160 continue its downward movement along the X axis. It should be noted that trip ball 138 has a full port bore 190, which is aligned with the Y axis in the run-in position, as shown in FIG. 3D. As soon as the trip ball 138 initiates its counterclockwise rotation after coming into contact with upper surface 172 of trip arm 170, the rotational movement of trip ball 138 continues until it has made a 90° revolution into the position shown in FIG. 4E. At that time, the trip arm 170 extends into bore 192. Bore 192 is transverse in the X-Y plane to bore 190. It is the extension of trip arm 170 into bore 192 which effectively stops the rotation of trip ball 138 in the position shown in FIG. 4E. At that time, bore 190 is fully in alignment with bore 50, giving a substantially clear passage through the apparatus A for further steps as will be described below. This is because the diameter of bore 190 is almost as large as bore 50.

Figure 4C:
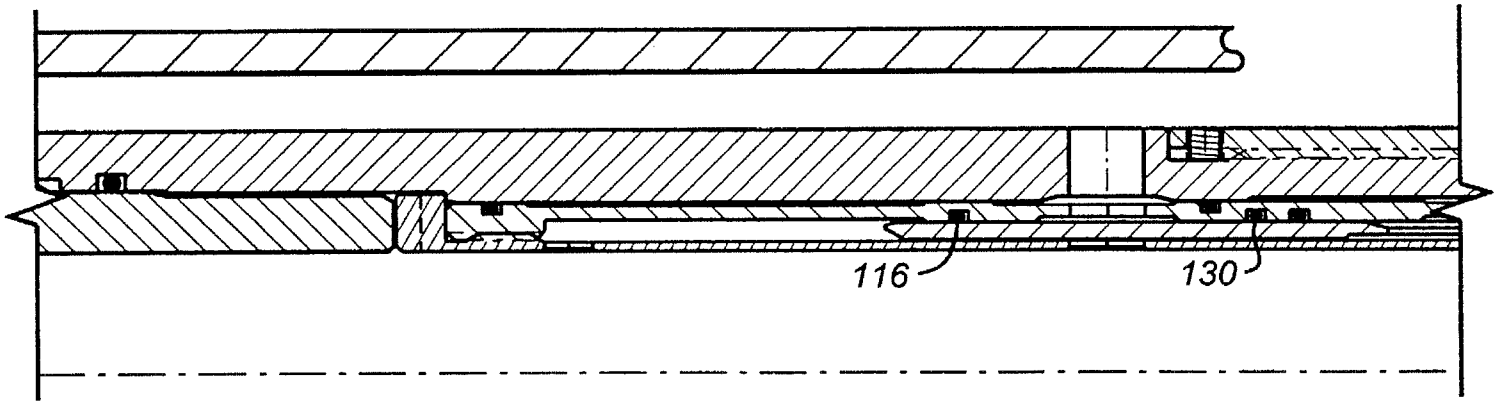

It should be noted that as the assembly of the upper ball support 118, the trip ball 138, and lower ball support 160 are translating downwardly, port 194 on upper ball support 118 is moving out of alignment with port 124 on the stationary trip ball lock 110. Eventually, port 194 passes beyond O-rings 130 and 132, effectively sealing off the bore 50 through the apparatus A from lateral ports 122 and 124 which ultimately lead to cavity 56 and hydraulic liner hanger 20. This closing of access to cavity 56 can be best seen by comparing FIGS. 3C to 4C. FIG. 4C indicates the upper ball support 118 in the shifted position such that a solid portion of upper ball support 118 is presented between seals 116 and 130.

Figure 4D:
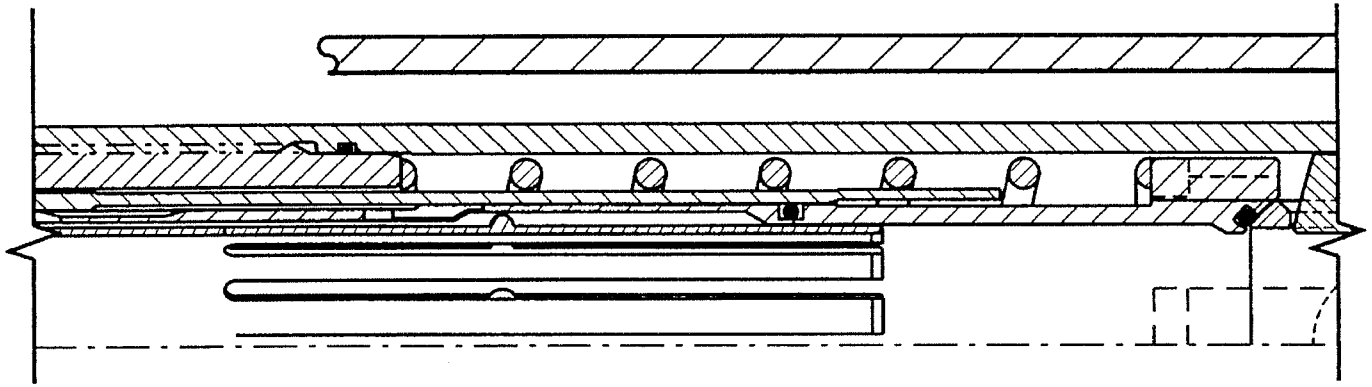
Figure 4E:
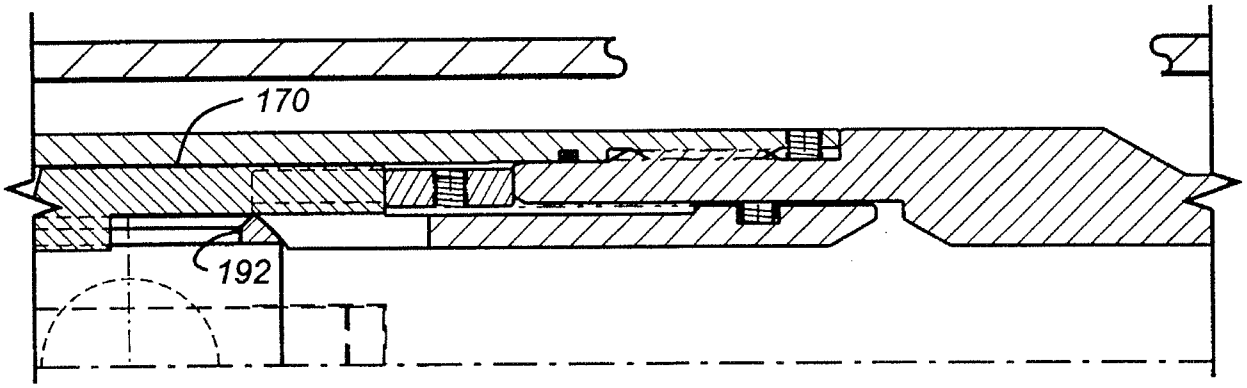

As the trip ball 138 rotates counterclockwise from the position shown in FIG. 3D to the position shown in FIGS. 4D and 4E, the ball 176 becomes dislodged from seat 178 and ultimately passes downhole through bore 190 after the 90° rotation takes place. In effect, the extension of trip arm 170 into bore 192 acts as a rotational travel stop about the X axis for the trip ball 138 to stop the movement of trip ball 138 at the position shown in FIGS. 4D and 4E. In an alternative design, the ball 176 can remain in place on seat 178 as the trip ball rotates if a provision is made in trip ball 138 to accept ball 176 wholly within itself.

It should be noted that the spring 144 assists in downward translation along the X axis of upper ball support 118 after screw or screws 162 are sheared. The ball guide 104 has a plurality of collet fingers 196 which are pushed into orientation to funnel ball 176 toward seat 178 for proper seating. When upper ball support 118 shifts projection 198 is no longer pushed inwardly by upper ball support 118 allowing collets 196 the freedom to flex radially outwardly to their relaxed state. Thereafter, collet fingers 196 have sprung aside when a cement wiper plug passes therethrough as will be described below. A projection 198 is provided on each of the collet fingers 196 to help them retain the position shown in FIG. 3D. Thereafter, after ball 176 has passed through bore 190, a cement wiper plug merely passes beyond the relaxed collet fingers 196 due to juxtaposition of recessed surface 199 opposite projections 198.

Figure 7:
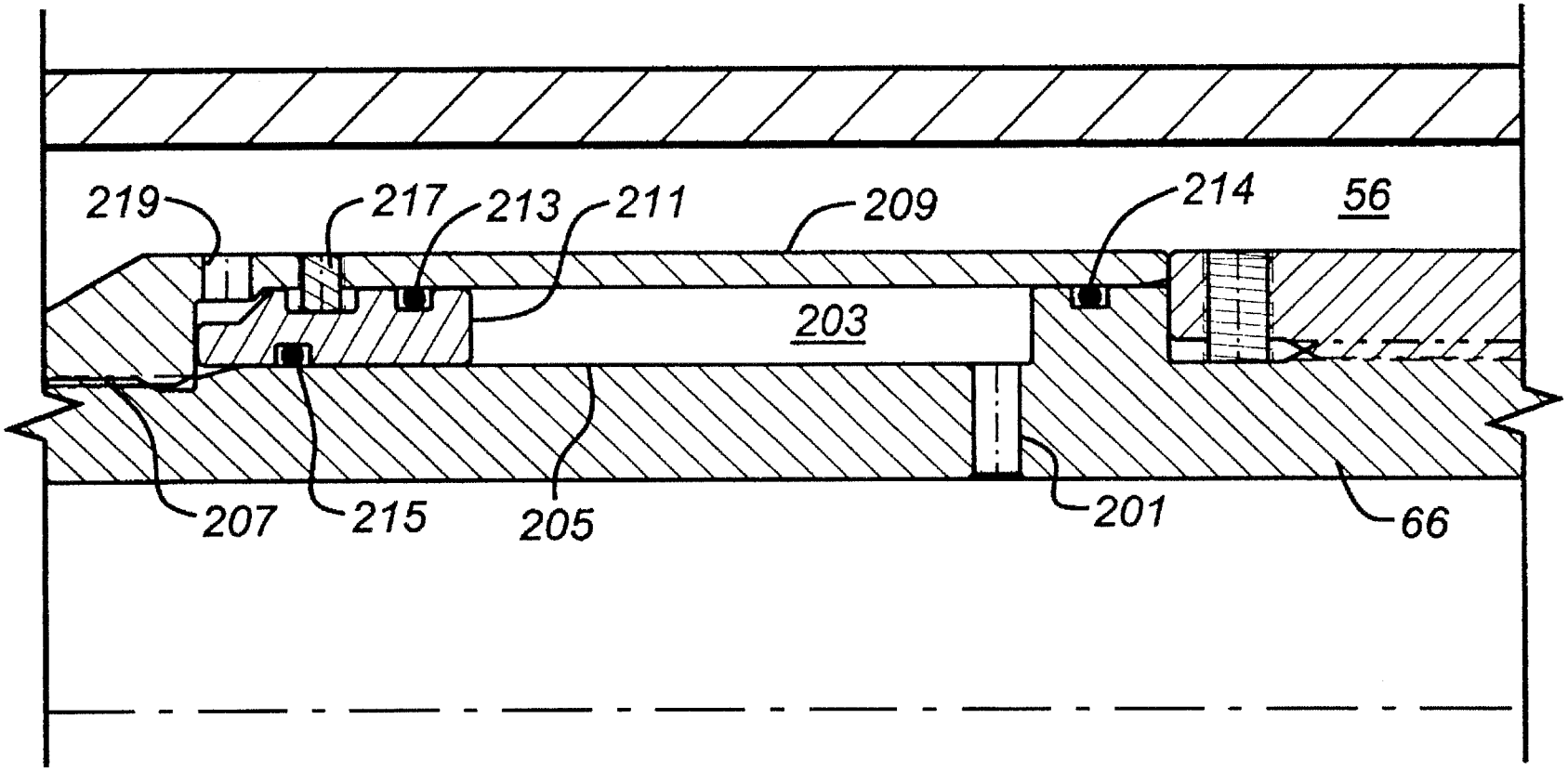
FIG. 7 is a detail of a wall section shown in FIGS. 2B and 3B, illustrating the pressure-equalization feature of the preferred embodiment.

Revised detail of upper connection 66 which allows for pressure-equalization after actuation of trip ball 138, as previously described. In the preferred embodiment which is illustrated for the apparatus A in FIG. 7, the upper connection 66 has a port 201, which communicates with cavity 203. Cavity 203 is formed by a recess 205 machined into upper connection 66, terminating at thread 207. Ring 209 is secured to upper connection 66 by thread 207. Therefore, cavity 203 is defined between ring 209 and upper connection 66. A piston 211 is movably mounted in cavity 203 and is in sealing engagement with it through seals 213 and 215. The initial position of piston 211 is shown in FIG. 7 and is so held by virtue of a shear pin 217, which extends into piston 211. Ring 209 has a port 219 which communicates with the opposite end of piston 211, then cavity 203. Ring 209 is sealed against upper connection 66 by seal 214. Accordingly, after the trip ball 138 is actuated in the manner described above, the pressure is initially trapped in cavity 56. However, after the pressure is reduced in bore 50, a pressure imbalance occurs on piston 211 because the pressure in port 219 exceeds the pressure in cavity 203. Eventually the imbalance is of sufficient proportion to shear pin 217 and displace piston 211 toward port 201. This creates a volume increase effectively in cavity 56 to a sufficient degree to release the trapped pressure therein without actual fluid communication from cavity 56 into bore 50.

Referring now to FIGS. 1 and 2, the entire procedure will be described in detail. The initial step is to set the liner hanger 20 in the manner previously described. Initially, the setting string illustrated in FIG. 2 is inserted into the liner string illustrated in FIG. 1 and latched thereto at liner setting tool 38. Upon pressurization having seated ball 176, the liner hanger 20 actuates at approximately 1200 lbs. of pressure. The pressure is further increased, causing a release between the setting string shown in FIG. 2 and the liner string shown in FIG. 1. Further pressure increases shear screws 162, allowing the trip ball 138 to rotate and cavity 56 to be isolated from bore 50. Now with the same string of FIG. 2 unlatched from the liner string of FIG. 1, but still physically located therein, cement is pumped down through the setting string of FIG. 2 all the way through the liner string of FIG. 1 until the cement exits from set shoe 34 and comes up in an annular space between the liner string illustrated in FIG. 1 and the existing casing in the wellbore from which the liner string of FIG. 1 is hung at liner hanger 20. After the appropriate amount of cement has been pumped into the setting string of FIG. 2, wiper plug 231 is dropped to pass through the setting string of FIG. 2 down to landing collar 30, where the first wiper plug 231 seats off. It should be noted that earlier when ball 176 passed through the trip ball 138, it later catches further down the liner assembly in FIG. 1 adjacent float collar 32. Although the ball 176 is caught at float collar 32, it does not fully obstruct the passage so that cement can be pumped around ball 176. When the first wiper plug 231 catches on landing collar 30, pressure builds up at the surface to indicate that this event has occurred. A small amount of drilling fluid is put in the wellbore behind the first wiper plug 231 and thereafter additional cement follows the second wiper plug 233. The setting string in FIG. 2 is raised until indicator collet 42 lands in indicating sub 28, which aligns the wash tool 40 with casing packer 26. The mud which was pumped behind the first wiper plug 231 occupies the volume between the landing collar 30 and indicating sub 28. Thereafter, the cement is pumped through the wash tool 40 into casing packer 26 to inflate casing packer 26 up against the open hole or the existing casing (not shown). Thereafter, the wash tool 40 is lifted to bring it into alignment with casing packer 22 by virtue of alignment of indicator collet 42 with indicating sub 24. Additional cement or other fluids are pumped to inflate packer 22 in the same manner as packer 26. The wash tool 40 is then further raised to bring it into alignment with packer 12 by virtue of alignment of indicator collet 42 with indicating sub 16. Again, the procedure is repeated where the cement or other fluids are used to inflate packer 12. The setting assembly of FIG. 2 is then retracted from the liner assembly of FIG. 1. Thereafter, circulation or reverse circulation from the surface can occur to remove any excess cement located above the liner assembly in FIG. 1 or within the setting assembly of FIG. 2. The procedures described above can also be used for hanging liners that are not cemented.

The net result of this procedure is that in one continuous operation, the liner hanger 20 can be set, with the cementing operation beginning immediately thereafter. With the lateral port to the liner hanger 20 isolated, pressurization can take place after setting the liner hanger 20 for accomplishing the cementing operation. Based on the steps described above, the end result is that at the conclusion of the cementing operation, the liner assembly of FIG. 1 is fully cemented with all packers set and its internal bore free of all cement. Thereafter, perforating can take place in the liner assembly of FIG. 1 and the proper production packers and production string installed in the customary maimer to begin production operations. The procedures described above can also be used for hanging liners that are not cemented.

While an assembly has been described which facilitates the closing of a lateral port to a liner hanger, it is within the scope of the invention to use the apparatus A of the present invention for other applications or to reverse the movements illustrated. For example, a lateral port 194 can be initially in the closed position, i.e., on the opposite side of O-ring 116 from the view of FIG. 3C, and be shifted into the open position as a result of rotation of trip ball 138. The setting tool can be used to actuate other downhole devices than liner hangers, such as packers, bridge plugs, etc. Alternatively, it is also within the scope of the invention to merely have the mechanism for actuating trip ball 138 to work independently of the opening and closing of an opening to allow fluid communication between cavity 56 and bore 50. Stated differently, a slide valve can be manually operated, as opposed to triggered for automatic operation as described in the preferred embodiment above.

Elements recited as one piece can be made of several pieces and vice versa. Singular elements can appear multiply and vice versa such as shear screws, parts, O-rings, etc.

It should be noted by following the procedure described for the cementing, where packers 26 and 22 are set in that order, the wash tool 40 wipes cement out of the liner string of FIG. 1 as it is worked up the liner until it is eventually removed at the end after setting packer 12. This bottom-to-top setting operation facilitates the removal of excess cement from inside the liner assembly illustrated in FIG. 1.

The foregoing disclosure and description of the invention are illustrative and explanatory thereof, and various changes in the size, shape and materials, as well as in the details of the illustrated construction, may be made without departing from the spirit of the invention.

We claim:

1. A setting tool for setting a least hydraulically actuated downhole tool, comprising:

a body having a bore therethrough and a lateral opening selectively open or closed for selective flow or pressure communication between said bore and a hydraulically actuated tool;

obstruction means in said bore for selective obstruction thereof to allow pressurization of the hydraulically actuated tool through said lateral opening, said obstruction means selectively movable from a first to a second position in said bore to provide, in said second position, a substantially unobstructed passage in said bore, actuation of said obstruction means from said first toward said second position actuates a change in orientation of said open or closed lateral opening;

actuation of said obstruction means from said first to said second position shifts a sleeve mounted on said body and having a lateral port thereon, from a first position, where said opening and said port are aligned for fluid communication, to a second position, where said opening and said port are misaligned to prevent fluid communication;

a wash tool connected to said body below said obstruction means and in fluid communication with said bore, whereupon placement of said sleeve in said second position additional hydraulically actuated tools can be actuated through applied pressure through said bore in said body through said wash tool without need to remove said body from the wellbore.

2. The setting tool of claim 1, further comprising:

a liner mountable to casing in a wellbore;

a hydraulically actuated hanger mounted to said liner;

at least one casing packer on said liner;

said lateral opening on said body in fluid communication with said hanger when said sleeve is in its said first position;

a seal assembly on said body to seal between said body and said hanger around said lateral opening;

whereupon shifting said sleeve to its said second position, said hanger is set on the casing and said body is released from said liner, allowing said wash tool to be positioned for fluid actuation of said packer without removal of said body from said liner.

3. The setting tool of claim 2, wherein:

removal of said body and wash tool from said liner leaves the interior of said liner essentially free of fluid which had previously been used to set said packer.

4. A setting tool for setting at least one hydraulically actuated downhole tool, comprising:

a body having a bore therethrough and a lateral opening selectively open or closed for selective flow or pressure communication between said bore and a hydraulically actuated tool;

obstruction means in said bore for selective obstruction thereof to allow pressurization of the hydraulically actuated tool through said lateral opening, said obstruction means selectively movable from a first to a second position in said bore to provide, in said second position, a substantially unobstructed passage in said bore, actuation of said obstruction means from said first toward said second position actuates a change in orientation of said open or closed lateral opening;

actuation of said obstruction means from said first to said second position shifts a sleeve mounted on said body and having a lateral port thereon, from a first position, where said opening and said port are aligned for fluid communication, to a second position, where said opening and said port are misaligned to prevent fluid communication;

said obstruction means further comprises:

a movable member having a first bore and a second bore and a seat circumscribing said first bore;

a valve member shaped to conform to said seat to obstruct said first bore when in contact with said seat;

said movable member, in a first position, having said first bore in substantial alignment with said bore in said body.

5. The tool of claim 4, wherein:

said movable member is mounted for translation and rotation from said first position toward a second position.

6. The tool of claim 5, wherein:

said sleeve supports said movable member for translation and rotation.

7. The tool of claim 6, further comprising:

a first detent on said body to preclude rotation of said movable member with respect to said sleeve until said sleeve translates a predetermined distance.

8. The tool of claim 7, further comprising:

a second detent on said body, said movable member contacting said second detent after clearing said first detent;

said second detent causing said movable member to rotate with respect to further translation of said sleeve to position said second bore on said movable member in substantial alignment with said bore in said body.

9. The tool of claim 8, wherein:

said movable member further comprises a pair of opposed flats in contact with said body to prevent said movable member from rotating on an axis extending through said first bore when said movable member is in its said first position.

10. The tool of claim 8, wherein:

said second bore is disposed transverse to said first bore on said movable member;

said second bore is substantially the size of said bore in said body and intersects said first bore;

said valve member comprises a sphere formed to the size of said seat.

11. The tool of claim 10, wherein:

said body further comprises:

a ball guide to guide said ball to said seat comprising a plurality of collets oriented toward said seat by support from said sleeve;

a frangible member selectively securing said sleeve to said body in said first position;

whereupon application of a predetermined pressure in the bore of said body, with said ball on said seat, shifts said sleeve and movable member upon breaking of said frangible member, causing said movable member to translate past said first detent and subsequently rotate by contact with said second detent to place said second bore in substantial alignment with said bore a said body while misaligning said port with respect to said lateral opening in said body.

12. The tool of claim 11, wherein:

said sleeve is in a plurality of connected segments disposed on opposed sides of said movable member;

said body further comprises a biasing means to push said sleeve, in a direction from said first to said second position of said sleeve, against said frangible member;

said second detent enters said first bore as said movable member rotates substantially 90° to orient said second bore with said bore in said body; and said shifting of said sleeve to its said second position undermining support for said collets allowing them to flex radially outwardly to substantially clear a path substantially the size of said second bore in said movable member;

said ball passing through said second bore as a result of said rotation of said movable member.

13. The setting tool of claim 11, wherein:

external seals on said body spanning said lateral opening for contact with the hydraulically actuated downhole tool;

relief means for relieving at least in part pressure trapped between said external seals after said sleeve shifts to its said second position.

14. The setting tool of claim 13, wherein:

said relief means comprises an equalizing piston movable in a cavity and exposed on one side to said bore in said body and on an opposite side to the exterior of said body between said seals;

whereupon movement of said piston increases volume between said external seals and as a result reduces pressure therebetween.

15. The tool of claim 14, wherein:

a shear pin holding said piston in a first position;

whereupon a pressure imbalance, caused by reducing pressure in said bore in said body, said shear pin breaks allowing said piston to move to reduce pressure externally of said body between said seals.

16. A setting tool for setting at least one hydraulically actuated downhole tool, comprising:

a body having a bore therethrough and a lateral opening selectively open or closed for selective flow or pressure communication between said bore and a hydraulically actuated tool;

obstruction means in said bore for selective obstruction thereof to allow pressurization of the hydraulically actuated tool through said lateral opening, said obstruction means selectively movable from a first to a second position in said bore to provide, in said second position, a substantially unobstructed passage in said bore;

actuation of said obstruction means from said first toward said second position actuates a change in orientation of said open or closed lateral opening;

actuation of said obstruction means from said first to said second position shifts a sleeve mounted on said body and having a lateral port thereon, from a first position, where said opening and said port are aligned for fluid communication, to a second position, where said opening and said port are misaligned to prevent fluid communication;

external seals on said body spinning said lateral opening for contact with the hydraulically actuated downhole tool;

relief means for relieving, at least in part, pressure trapped between said external seals after said sleeve to its said second position.

17. The tool of claim 16, wherein:

said relief means comprises an equalizing piston movable in a cavity and exposed on one side to said bore in said body and on an opposite side to the exterior of said body between said seals;

whereupon movement of said piston increases volume between said external seals and as a result reduces pressure therebetween.

18. The tool of claim 17, further comprising:

a shear pin holding said piston in a first position;

whereupon a pressure imbalance, caused by reducing pressure in said bore in said body, said shear pin breaks allowing said piston to move to reduce pressure externally of said body between said seals.

19. A hydraulic setting tool for a liner hanger used to attach a liner to casing, comprising:

a body having a bore therethrough;

a movable sleeve movable between a first and second position having a lateral port which is selectively positioned in alignment and misalignment of a lateral opening on said body, in said first and second positions, respectively;

external seals on said body spanning said lateral port and contacting said liner hanger;

a movable member supported by said sleeve and movable with respect to said sleeve between a first position and a second position;

said movable member in said first position capable of obstructing said bore in said body to allow pressure buildup to the liner hanger through said lateral opening;

said movable member when moved to its said second position by moving said sleeve toward its said second position causes said misalignment between said lateral port and said lateral opening while presenting a substantially unobstructed path in said bore of said body.

20. The tool of claim 19, wherein:

said movable member comprises a first bore having a seat circumscribing said first bore;

a valve member shaped to conform to said seat to selectively obstruct the bore in said body when placed in contact with said seat;

detent means on said body to limit initial movement of said movable member to translation with said movable sleeve.

21. The tool of claim 20, further comprising:

stop means on said body to prevent further translation of said movable member as it moves between its said first and second positions, said stop means initiating rotation of said movable member with respect to said movable sleeve which continues translation toward its said second position.

22. The tool of claim 21, wherein:

said detent means disengages from said movable member after said sleeve has translated said movable member a distance which brings said movable member in contact with said stop means to force said movable member to rotate about at least one axis upon contact with said stop means.

23. The tool of claim 22, further comprising:

a second bore in said movable member transverse to said first bore and sealingly isolated from said bore in said body when said movable member is in said first position, said second bore substantially as large as said bore in said body:

said stop means engaging said movable member in an offset manner to initiate a 90° rotation aligning said second bore with said bore in said body.

24. The tool of claim 23, further comprising:

biasing means on said body urging said sleeve toward its said second position;

said valve member comprises a sphere, said sphere knocked out of contact with said seat and passing through said second bore upon said 90° rotation of said movable member;

said sleeve selectively secured to said body by a frangible member in its said first position;

whereupon application of a predetermined fluid pressure against said movable member with said sphere still seated on said seat, said frangible member fails allowing said biasing means to translate said sleeve toward its said second position.

25. The tool of claim 24, further comprising:

a ball guide on said body comprising a plurality of collet fingers forming an opening in alignment with said seat when supported by said sleeve in its said first position, whereupon movement of said sleeve toward its said second position said collets become unsupported allowing them to move radially outwardly, substantially clear of said second bore after said second bore has rotated 90° into substantial alignment with said bore in said body.

26. The tool of claim 25, further comprising:

pressure relief means in said body for relieving trapped pressure between said seals outside said body by increasing trapped volume between said seals without flow communication from outside said body and into said bore.

27. The tool of claim 26, wherein:

said pressure relief means further comprises:

a cavity in said body;

a piston in said cavity isolating a first and second compartments in said cavity from each other, said first compartment in flow communication with outside said body and between said seals said second compartment in flow communication with said bore in said body;

retaining means on said piston preventing it from moving until a predetermined force imbalance from said first compartment causes said retaining means to fail.

28. The tool of claim 19, further comprising:

pressure relief means in said body for relieving trapped pressure between said seals outside said body by increasing trapped volume between said seals without flow communication from outside said body into said bore.

29. The tool of claim 28, wherein:

said pressure relief means further comprises:

a cavity in said body;

a piston in said cavity isolating a first and second compartments in said cavity from each other, said first compartment in flow communication with outside said body and between said seals said second compartment in flow communication with said bore in said body;

retaining means on said piston preventing it from moving until a predetermined force imbalance from said first compartment causes said retaining means to fail.

30. A method of hanging a liner, comprising:

suspending a liner on a setting tool;

inserting the liner having a hydraulically actuated hanger into preexisting casing in a wellbore;

closing off a bore in the setting tool;

dropping a ball onto a seat in a movable member to accomplish said closing off;

applying pressure into the bore of the setting tool;

communicating said applied pressure through the body of said setting tool to said hydraulically actuated hanger;

setting said hanger against the casing;

guiding said movable member to translate when a predetermined pressure is exceeded;

breaking a frangible member to allow said translation;

unlocking the movable member to rotate after a predetermined translation;

initiating rotation of said movable member after said translation;

aligning a bore in said movable member with said bore in said setting tool due to said rotation;

opening said bore in said setting tool;

closing pressure communication from said bore in said setting tool to said hanger through said body of said setting tool, as a result of said opening said bore step.

31. The method of claim 30, further comprising:

supporting said movable member with a bored sleeve;

aligning a port in said sleeve with an opening in the setting tool as a result of said inserting to allow pressurization of said hydraulic hanger;

providing a ball guide to direct said ball to said seat;

supporting said ball guide with said sleeve during said inserting.

32. The method of claim 31, further comprising:

shifting said sleeve to undermine support for said guide and to misalign said opening and said port;

rotating said movable member substantially 90°;

allowing said guide to flex radially outwardly within said bore of said setting tool;

presenting a flowpath through said setting tool at least as large as said bore in said movable member after its said 90° rotation;

forming said bore in said movable member substantially as large as said bore in said sleeve.

33. The method of claim 32, further comprising:

trapping pressure between said setting tool and said hanger from said closing pressure communication step;

moving a piston to expand the trapped volume between said setting tool and said hanger;

reducing trapped pressure by said piston movement.

34. The method of claim 33, further comprising:

suspending a wash tool on said setting tool during said insertion of said liner;

repositioning said wash tool adjacent a casing packer after said opening said bore step;

setting said casing packer with a fluid;

removing the setting and wash tools from said liner.

35. A setting tool for setting at least one hydraulically actuated downhole tool, comprising:

a body having a bore therethough and a lateral opening selectively open or closed for selective flow or pressure communication between said bore and a hydraulically actuated tool;

obstruction means in said bore for selective obstruction thereof to allow pressurization of the hydraulically actuated tool through said lateral opening, said obstruction means selectively movable from a first to a second position in said bore to provide, in said second position, a substantially unobstructed passage in said bore;

actuation of said obstruction means from said first toward said second position actuates a change in orientation of said open or closed lateral opening;

actuation of said obstruction means from said first to said second position shifts a sleeve mounted on said body and having a lateral port thereon, from a first position, where said opening and said port are misaligned preventing fluid communication, to a second position, where said opening and said port are aligned for fluid communication.

36. A method of hanging a liner, comprising:

suspending a liner on a setting tool;

inserting the liner having a hydraulically actuated hanger into preexisting casing in a wellbore;

closing off a bore in the setting tool;

applying pressure into the bore of the setting tool;

communicating said applied pressure through the body of said setting tool to said hydraulically actuated hanger;

setting said hanger against the casing;

opening said bore in said setting tool;

closing pressure communication from said bore in said setting tool to said hanger through said body of said setting tool, as a result of said opening said bore step;

trapping pressure between said setting tool and said hanger from said closing pressure communication step;

moving a piston to expand the trapped volume between said setting tool and said hanger;

reducing trapped pressure by said piston movement.

37. A method of setting a downhole tool, comprising:

suspending a downhole tool on a setting tool;

inserting the downhole tool having a hydraulically actuated mechanism into a wellbore;

closing off a bore in the setting tool;

applying pressure into the bore of the setting tool;

communicating said applied pressure through the body of said setting tool to said hydraulically actuated mechanism;

dropping a ball onto a seat in a movable member to accomplish said closing off;

guiding said movable member to translate when a predetermined pressure is exceeded;

breaking a frangible member to allow said translation;

unlocking the movable member to rotate after a predetermined translation;

initiating rotation of said movable member after said translation;

aligning a bore in said movable member with said bore in said setting tool due to said rotation;

setting said downhole tool;

opening said bore in said setting tool;

closing pressure communication from said bore in said setting tool to said hydraulically actuated mechanism through said body of said setting tool, as a result of said opening said bore step.

38. A method of hanging a liner, comprising:

suspending a liner on a setting tool;

inserting the liner having a hydraulically actuated hanger into preexisting casing in a wellbore;

closing off a bore in the setting tool;

applying pressure into the bore of the setting tool;

communicating said applied pressure through the body of said setting tool to said hydraulically actuated hanger;

setting said hanger against the casing;

opening said bore in said setting tool;

closing pressure communication from said bore in said setting tool to said hanger through said body of said setting tool, as a result of said opening said bore step;

suspending a wash tool on said setting tool during said insertion of said liner;

repositioning said wash tool adjacent a downhole tool after said opening said bore step;

setting said downhole tool with a fluid;

removing the setting and wash tools from said liner.

39. The method of claim 38, further comprising:

using a casing packer as said downhole tool in said repositioning and setting steps.

40. A method of setting at least one downhole tool, comprising:

suspending a first downhole tool on a setting tool;

inserting said first downhhole tool having a hydraulically actuated mechanism into preexisting casing in a wellbore;

closing off a bore in the setting tool;

applying pressure into the bore of the setting tool;

communicating said applied pressure through the body of said setting tool to said hydraulically actuated mechanism;

setting said mechanism;

opening said bore in said setting tool;

closing pressure communication from said bore in said setting tool to said mechanism through said body of said setting tool, as a result of said opening said bore step;

suspending a wash tool on said setting tool during said insertion of said liner;

repositioning said wash tool adjacent a second downhole tool after said opening said bore step;

setting said second downhole tool with a fluid;

removing the setting and wash tools from said wellbore.

41. The method of claim 40, further comprising:

using a casing packer as said downhole tool in said repositioning and setting steps.

* * * * *